United States Patent [19]

Schürmann

[11] Patent Number: 4,523,677

[45] Date of Patent: Jun. 18, 1985

[54] BOTTLE HOLDER

[75] Inventor: Heiner J. Schürmann, Greenville, S.C.

[73] Assignee: American Ka-ro Corporation, Greenville, S.C.

[21] Appl. No.: 519,815

[22] Filed: Aug. 3, 1983

[51] Int. Cl.[3] ..... B65D 71/00; B65D 71/04

[52] U.S. Cl. ..... 206/158; 206/151; 206/161; 206/427; 294/87.2

[58] Field of Search ..... 206/145-161, 206/427; 294/87.2, 87.28

[56] References Cited

U.S. PATENT DOCUMENTS

| | | | |
|---|---|---|---|
| D. 238,249 | 12/1975 | Erickson | 294/87.2 |
| 3,633,962 | 1/1972 | Erickson | 294/87.2 |
| 4,139,094 | 2/1979 | Berry et al. | 206/148 |
| 4,159,841 | 7/1979 | Calvert | 206/159 |
| 4,235,468 | 11/1980 | Erickson | 206/151 |
| 4,249,766 | 2/1981 | Erickson | 294/87.2 |

*Primary Examiner*—William T. Dixson, Jr.
*Assistant Examiner*—Brenda J. Ehrhardt
*Attorney, Agent, or Firm*—Bailey & Hardaway

[57] ABSTRACT

A molded plastic bottle holder is illustrated wherein individual rib sections are provided for receiving respective necks of the bottles held to form a package. Each of the individual rib sections carries a number of segmental flexible lip members extending upwardly and inwardly to receive the neck of the bottle and wedge shaped members are carried by marginal portions of the flexible lip members to define an opening and to add rigidity at the opening to facilitate removal of a bottle from the bottle holder while ensuring adequate gripping action during handling.

3 Claims, 4 Drawing Figures

Fig. 3.
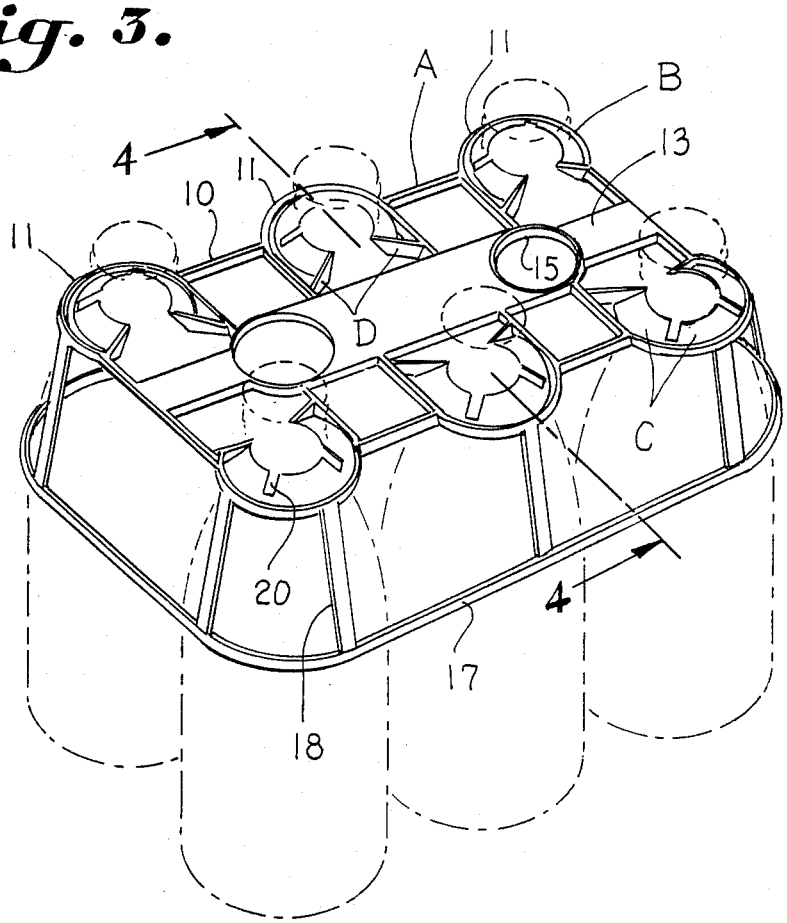
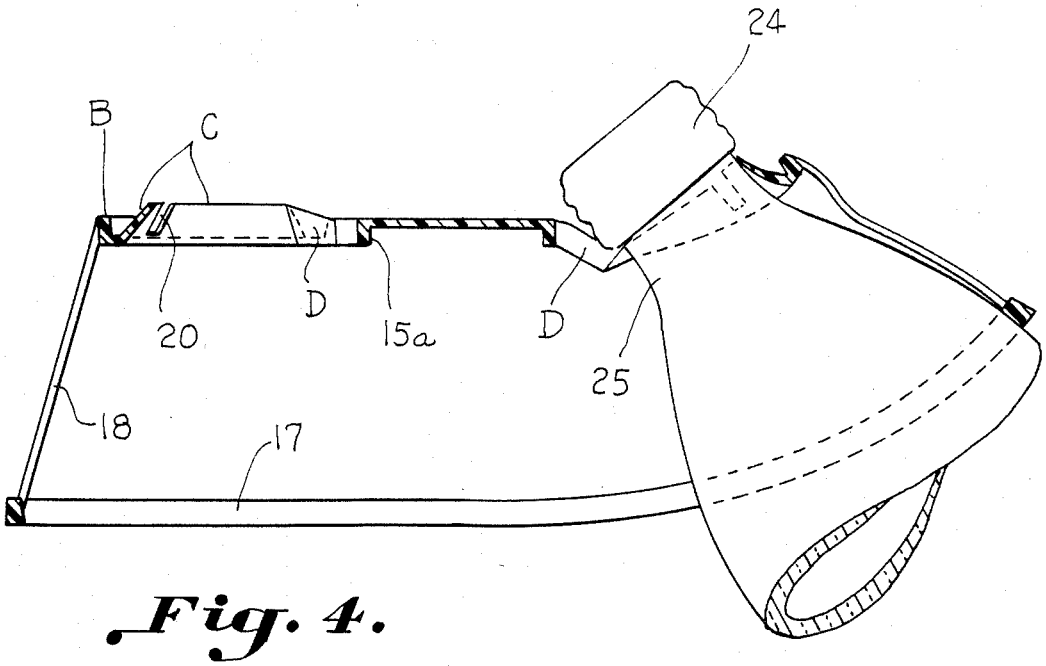
Fig. 4.

BOTTLE HOLDER

BACKGROUND OF THE INVENTION

A bottle carrier is illustrated in U.S. Pat. No. 3,633,962 having individual frames, in the form of split collars, supported within a larger frame. A skirt member, including a retaining loop, is provided for attachment to a bottle carrier, and is illustrated in U.S. Pat. No. 4,235,468. U.S. Pat. No. 4,139,094 illustrates a bottle carrier in common use wherein a molded plastic sheet of relatively uniform thickness contains segmental inwardly extending flexible lip member carried in individual bottle sections. A skirt in the form of a sheet member depends from the bottle receiving sections. This latter device has the disadvantage of obscuring the bottles contained within the package while making bottle removal somewhat difficult. The other patented carriers possess a disadvantage in that it is difficult to place the bottle within the carrier because failure to present the bottles in proper alignment with the collars during the forcing of the bottles into the receiving collars results in the collars hanging up with consequent damage and insufficient retension of the bottles.

Accordingly, it is an important object of this invention to provide a unitary plastic bottle carrier wherein the necks of the bottles may be readily inserted even when alignment between the bottes and the individual receiving sections is not perfect, and which will also facilate removal of the bottle while affording adequate bottle retension during handling of the bottle package.

Another important object of the invention is the provision of an inexpensive bottle holder which will not obscure the upper portions of the bottles while facilitating insertion and removal of the bottles from the bottle holder.

SUMMARY OF THE INVENTION

It has been found that a bottle holder may be provided having lips extending inwardly from a rib forming each bottle receiving section, with the provision of an opening inboard of each receiving section. At the lips the opening is of lesser extent than at the neck of a bottle received therein.

A diverging wedge shaped rib integral with the rib forming each bottle receiving section is integrally joined with a marginal portion of opposed lip portions facilitating removal of the bottle through the opening defined by the wedge shaped ribs while assuring adequate retention of the bottles during handling of the package.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a perspective view, at a reduced scale, illustrating a bottle holder constructed in accordance with the present invention retaining a number of bottles to form a package facilitating handling and removal of the bottles, and FIG. 4 is an enlarged transverse sectional elevation when taken on the line 4—4 in FIG. 3 illustrating the wedge shaped reinforcement portions of the gripping members affording adequate gripping action but facilitating removal of the bottles through the space provided opposite the opening defined by the wedge shaped portions.

DESCRIPTION OF A PREFERRED EMBODIMENT

Figure 1:
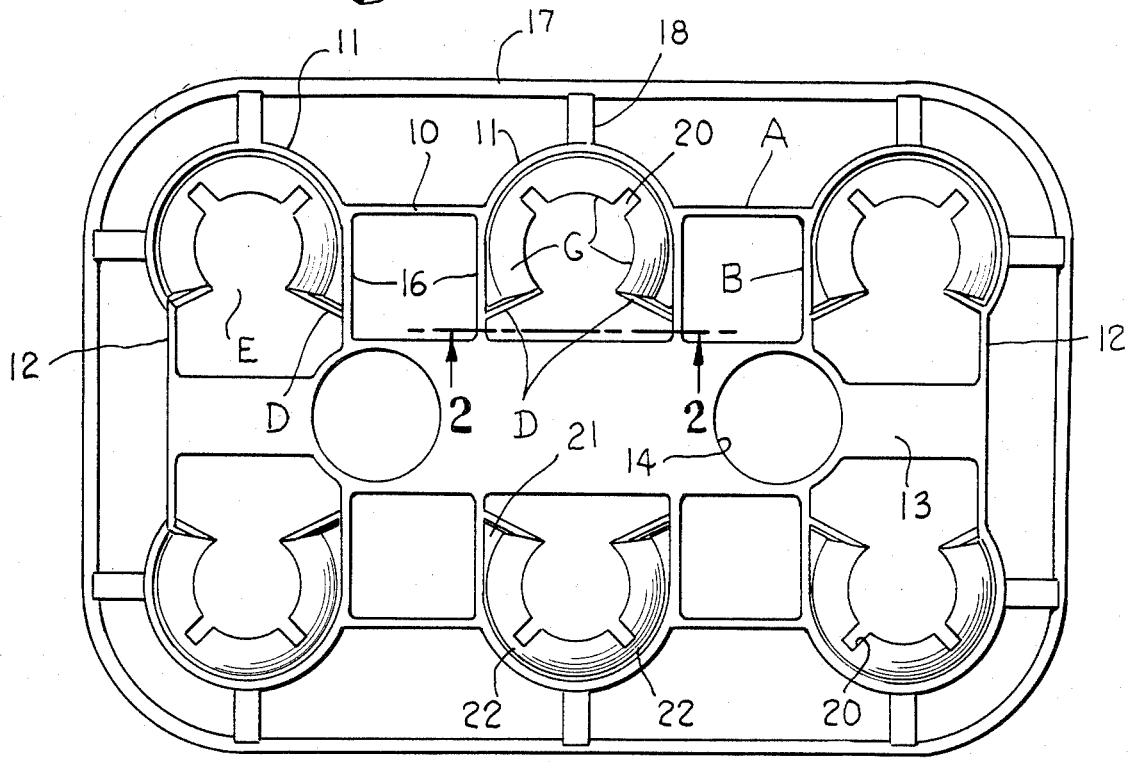
FIG. 1 is a plan view illustrating a bottle holder constructed in accordance with the present invention.

The drawings illustrate a unitary bottle holder constructed of molded synthetic polymeric material for retaining a number of bottles having necks in a package to facilitate handling. A frame A surrounds the necks of the bottles in the package. The frame has a plurality of interconnected individual rib sections B each for receiving a neck of a bottle. A plurality of segmental flexible lip members C extend integrally from the rib sections along major portions thereof. The flexible lip members extend upwardly and inwardly, terminating to receive the neck of a bottle with a resilient gripping action. Spaced inwardly, converging slots define the flexible lips. A pair of upstanding converging wedge shaped ribs D are carried integrally by marginal portions of the lip members tapering outwardly from the rib sections defining inwardly facing, outwardly tapering openings E of lesser width than a bottle neck, each accommodating a neck of a bottle for removal when a respective neck is forced between the wedge shaped ribs for removal of a bottle from the package.

A bottle holder is illustrated as including a unitary member of molded plastic having a frame member A which generally surrounds the bottles and is illustrated as including rib segments 10 which extend between the individual rib sections B which form the individual receiving members for confining the necks of bottles of the package. The segments 10 are connected to the respective rib sections B which include circular portions 11 together with segments 12 at the ends, as well as a handle section 13 having openings 14 for a finger and thumb, said opening being defined by a depending rib portions 15 (FIG. 3). The handle section 13 has a marginal dependent rib portion **15*a* to add rigidity thereto. Intermediate segments 16 connect the arcuate rib section 11 to the handle portion 13**.

It will be noted that the bottle holder illustrated is provided with a skirt which includes a looped rib member 17 having connecting members 18 for securing same to the upper portion of the bottle holder described above.

A number of segmental lip members C extend integrally from the rib sections along major portions thereof and are formed of relatively thin flexible plastic which is illustrated as tapering inwardly from the rib sections. The lip members C are defined by inwardly converging slots 20. An opening is formed in respective bottle receiving sections facing inwardly toward the handle section 13 which is not so large as to permit free passageway of the neck of the bottle retained therein and which is illustrated as being on the order of about that portion which would be occupied by one of the lip members C.

Figure 2:
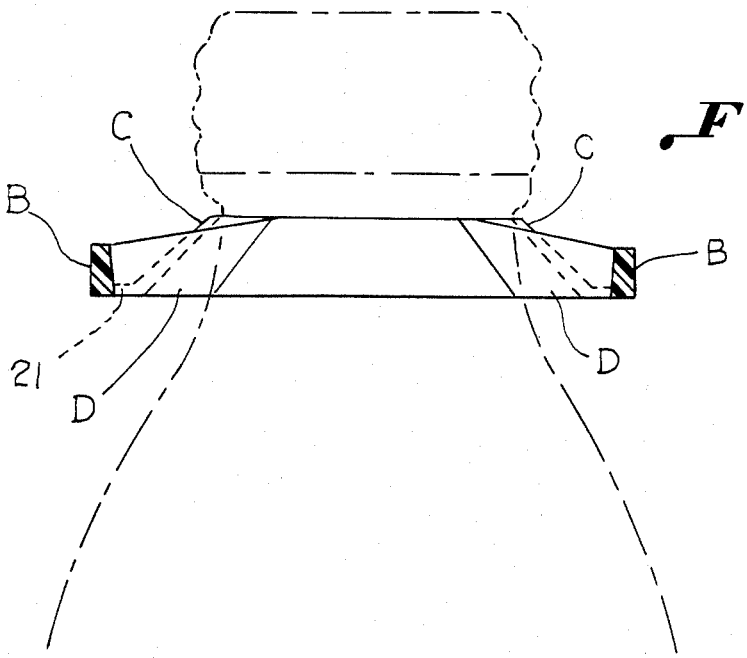
FIG. 2 is an enlarged longitudinal sectional elevation when taken on the line 2—2 in FIG. 1.

A pair of upstanding converging wedge shaped ribs D is formed by marginal portions of the lip members in each of the bottle receiving sections defining the openings E. The wedge shaped ribs D are best illustrated in FIG. 2 and are joined integrally with the individual rib sections B on one end and extend inwardly along a substantially triangular portion 21 of a lip forming section which extends entirely within the individual rib sections B and are integrally connected with marginal portions of the lip members serving as bridging members between the rib sections and lip portions. On an opposite end the wedge shaped members are illustrated as tapering upwardly substantially to a point adjacent the lip portions.

It will be observed that the tapering openings are arranged opposite each other and inboard of the ribbed frame. The slots 20 terminate short of the rib sections forming bridging members 22 between the lip members increasing the gripping action exerted thereby upon the bottles.

It is thus seen that the lip sections are formed of relatively thin plastic portions and are of sufficient size and extent as to guide a bottle cap 24 which forms a part of the neck 25 of respective bottles within the receiving sections for retaining the bottle neck portions therein. The spaces facing the respective openings E which are made possible by the strength or reinforcing action of the wedge shaped members which define the openings and which permit removal while affording the strengthening action to insure proper retention during handling.

While a preferred embodiment of the invention has been described using specific terms, such description is for illustrative purposes only and it is to be understood that changes and variations may be made without departing from the spirit or scope of the following claims.

What is claimed is:

1. A unitary bottle holder constructed of molded synthetic polymeric material for retaining a number of bottles having necks in a package having a longitudinal central handle section to facilitate handling comprising:

a frame surrounding the necks of the bottles in the package extending about the handle section;

said frame having a plurality of spaced interconnected individual rib sections each extending outwardly from said handle section and thence being connected by an arcuate portion for receiving a neck portion of a bottle;

a plurality of segmental flexible lip members extending integrally from said rib sections along major portions thereof;

said flexible lip members extending upwardly and inwardly terminating to form an opening receiving the neck of a bottle in a resilient gripping action;

spaced inwardly converging slots defining said flexible lip members; and a pair of upstanding converging wedge shaped ribs each carried integrally by marginal portions of said lip members tapering outwardly from said rib sections terminating in an inner edge of said lips defining inwardly facing, outwardly tapering openings of lesser width than a bottle neck each accommodating a neck of a bottle for removal when a respective neck is forced between said wedge shaped ribs for removal of a bottle from the package.

2. The structure set forth in claim 1 wherein said tapering openings are arranged opposite each other and inboard of the ribbed frame.

3. The structure set forth in claim 1 wherein said slots terminate short of said rib sections forming bridging portions between lip members increasing the gripping action upon the bottles.

* * * * *